US006193126B1

(12) United States Patent
Lee

(10) Patent No.: US 6,193,126 B1
(45) Date of Patent: Feb. 27, 2001

(54) NOSE ASSEMBLY FOR A NAIL EJECTION GUN

(75) Inventor: Arosun Lee, Taipei (TW)

(73) Assignees: Nailermate Enterprise Corporation, Taipei (TW); Markwell Manufacturing Company Inc., Norwood, MA (US)

( * ) Notice: Subject to any disclaimer, the term of this patent is extended or adjusted under 35 U.S.C. 154(b) by 0 days.

(21) Appl. No.: 09/617,017

(22) Filed: Jul. 14, 2000

(51) Int. Cl.[7] ..... B25C 5/04; B27F 7/16
(52) U.S. Cl. ..... 227/83; 227/123
(58) Field of Search ..... 227/83, 119, 123, 227/120, 128, 130, 127

(56) References Cited

U.S. PATENT DOCUMENTS 3,152,335 * 10/1964 Wandel et al. ..... 227/83
3,291,357 * 12/1966 Ruskin ..... 227/83
3,417,908 * 12/1968 Treatman ..... 227/83
3,807,619 * 4/1974 Doyle ..... 227/123
4,013,206 * 3/1977 Lemos ..... 227/123
4,574,992 * 3/1986 Holman ..... 227/83

* cited by examiner

*Primary Examiner*—Scott A. Smith
(74) *Attorney, Agent, or Firm*—Charles E. Baxley

(57) ABSTRACT

A nose assembly for a nail gun includes a nose piece connected to a gun body and the nose piece has a guide channel in a surface thereof. A resilient strip has its first end fixedly connected to the nose piece and a guide base is located below the nose piece. The nose piece has an extension channel which is in alignment with the guide channel, and a second end of the resilient strip is connected to the guide base. Two oblique surfaces are respectively defined in two inside defining the extension channel and a block extends from a surface defining the extension channel. Two grooves are defined between the block and the two oblique surfaces so that two legs of nails will be separated and inserted into the grooves before penetrating into document.

4 Claims, 6 Drawing Sheets

NOSE ASSEMBLY FOR A NAIL EJECTION GUN

FIELD OF THE INVENTION

The present invention relates to a nose assembly for a nail ejection gun and the assembly includes a nose piece with two oblique guides, an end of a resilient strip connected to the nose piece and a guide base connected to the other end of the resilient strip. The guide base has two inclined grooves and is located below the nose piece.

BACKGROUND OF THE INVENTION

A conventional nose assembly for a nail ejection gun is shown in FIG. 1 and the nail ejection gun generally includes a gun body 2 and a nail magazine 4 is connected to the gun body 2. A nose piece 3 is connected to the gun body 2 by bolts 7 extending through holes 30 in the nose piece 3 and fixed to the gun body 2. A guide channel 31 is defined in a surface of the nose piece 3. Two oblique guides 311 extend from a lower end of the nose piece 3 and a recess 312 is defined between the two oblique guides 311. A resilient strip 5 has a first end thereof connected to the nose piece 3 and a second end of the resilient strip 5 is a trapezoid limit piece 51 which is located in the recess 312. The two oblique guides 311 and the limit piece 51 restrain two legs of a nail to be expanded when penetrating through papers.

In practice, the shape of the limit piece 51 is required to be precise and accurate so that the two legs of nails can be evenly expanded. However, it is difficult to economically manufacture the limit piece with satisfied precision and to install the limit piece at a suitable position in the recess 312 because the second end of the resilient strip 5 is a free end.

The present invention intends to provide a nose assembly for a nail ejection gun wherein the second end of the resilient strip is connected to a guide base having two guide grooves separated by a tapered block. The guide base is pushed by the striking needle when ejecting a nail.

SUMMARY OF THE INVENTION

In accordance with one aspect of the present invention, there is provided a nose assembly for a nail gun and comprising a nose piece connected to a gun body and the nose piece has a guide channel. A resilient strip has a first end thereof fixedly connected to the nose piece and a second of the resilient strip is connected to a guide base located below the nose piece. The guide base has an extension channel which is in alignment with the guide channel. Two oblique surfaces are respectively defined in two inside defining the extension channel and a block extends from a surface defining the extension channel and has a tapered surface which communicates with the extension channel. Two grooves are defined between the block and the two oblique surfaces.

The object of the present invention is to provide a nose assembly for a nail gun wherein the grooves guiding the two legs of nails are easily to be controlled.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
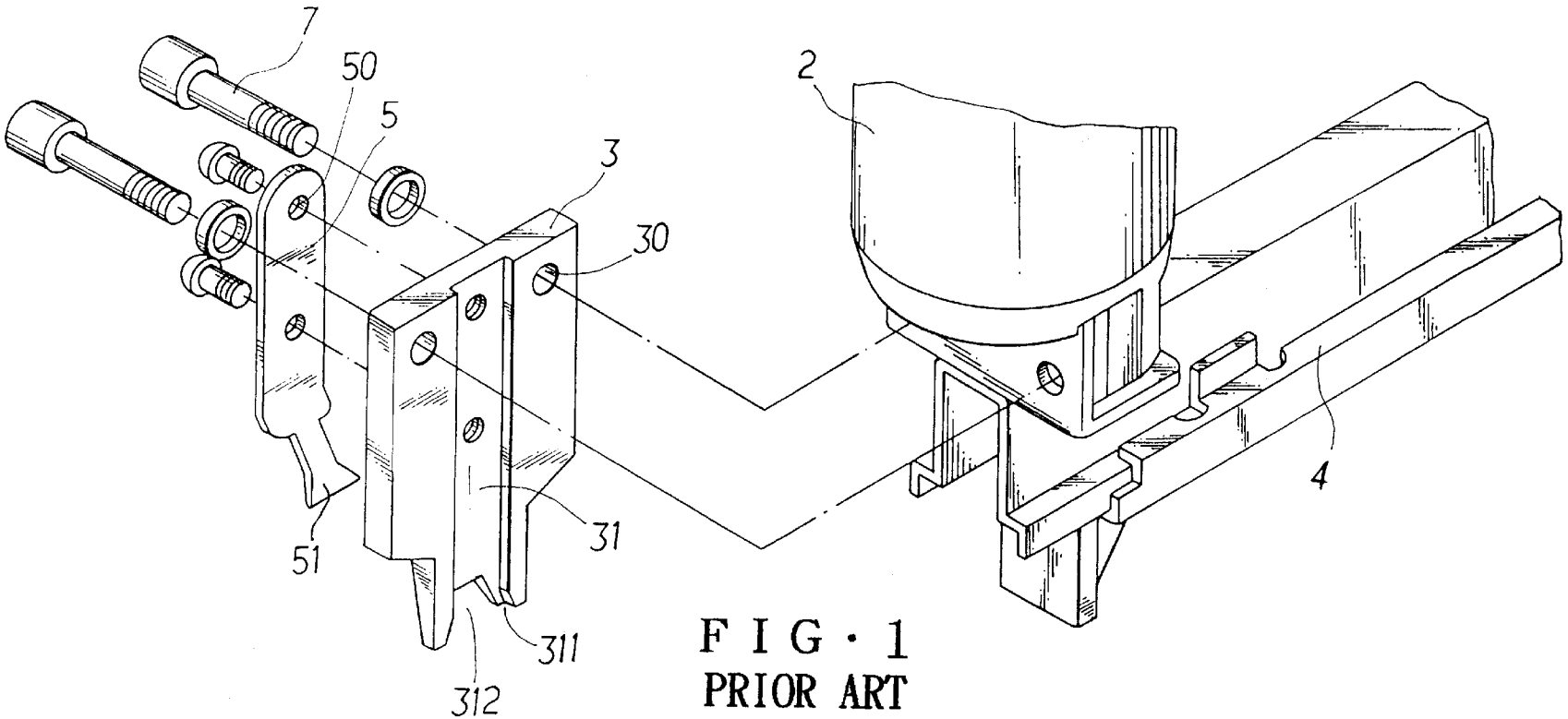
FIG. 1 PRIOR ART
FIG. 1 is an exploded view to show a conventional nose assembly for a nail ejection gun.
Figure 2:
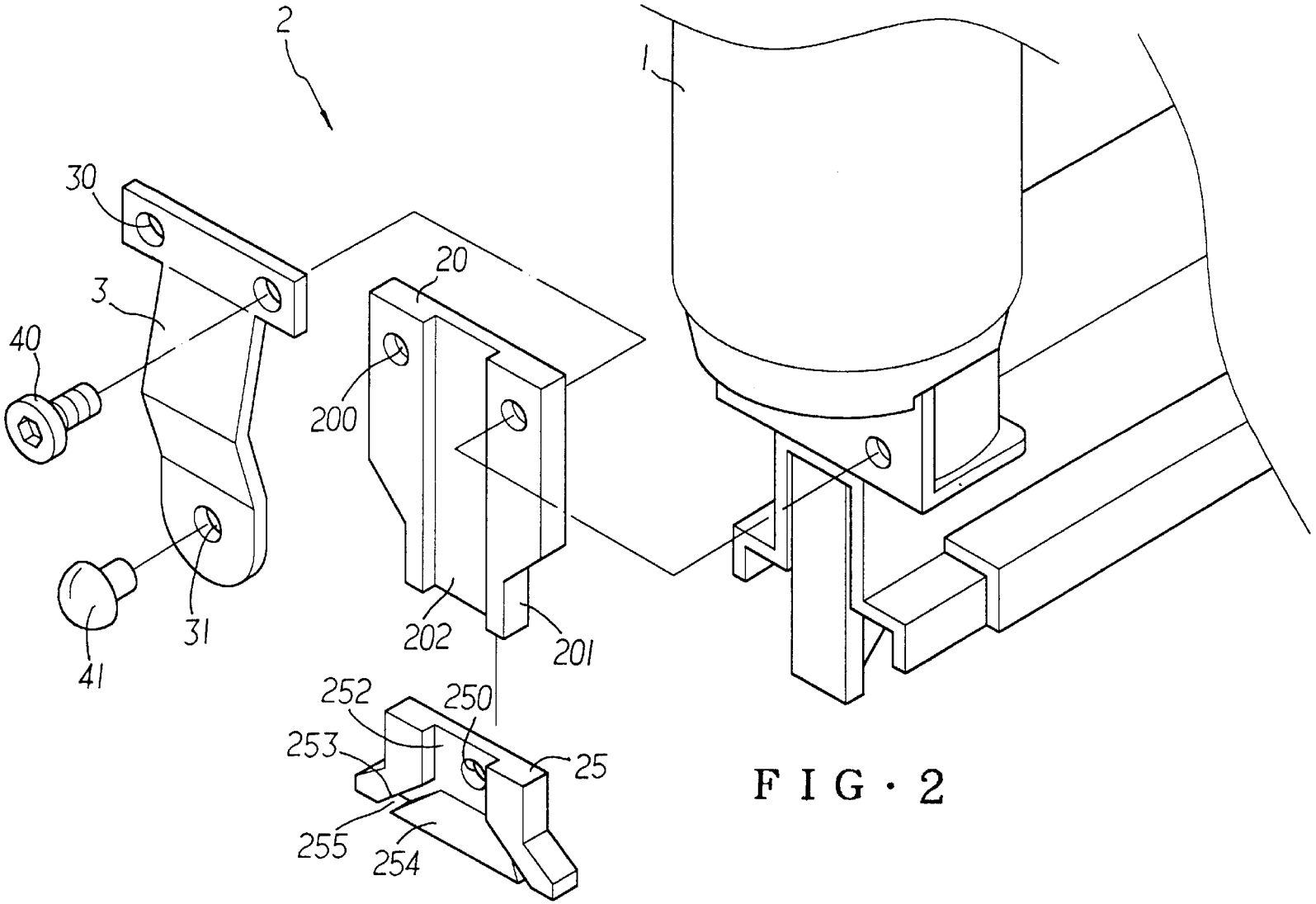
FIG. 2 is an exploded view to show a nose assembly for a nail ejection gun of the present invention.
Figure 3:
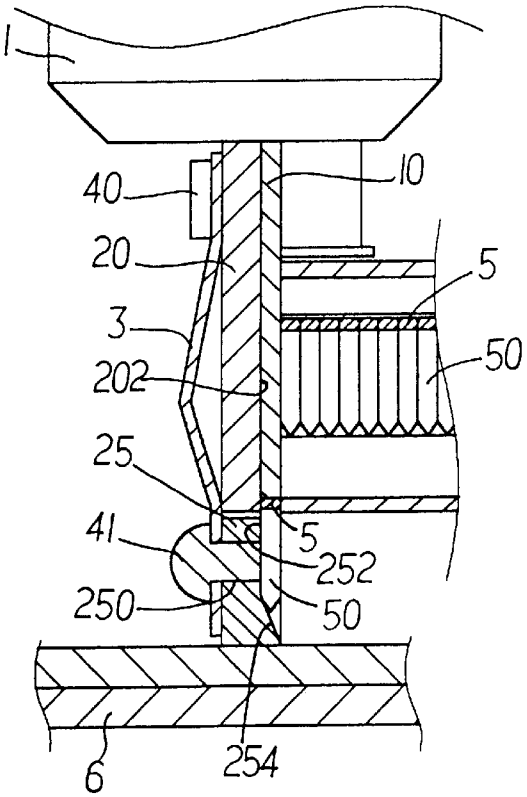
FIG. 3 is a cross sectional side view to show the nose assembly when the striking needle is not yet lowered.
Figure 6:
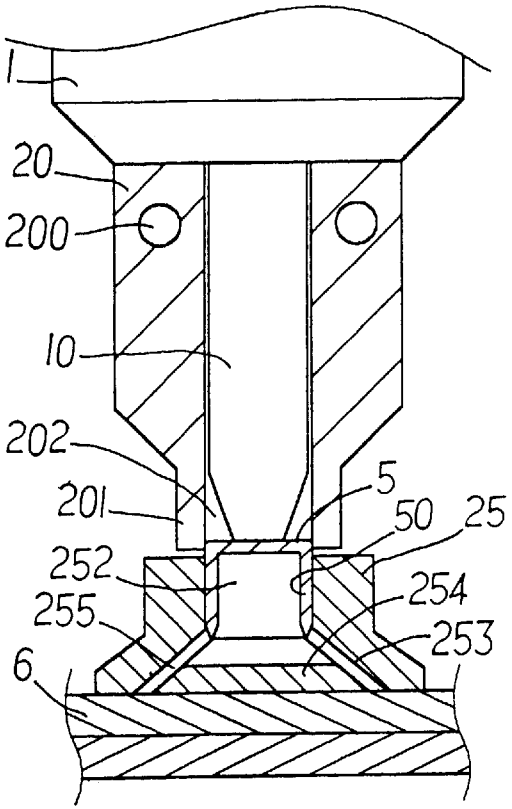
FIG. 6 is a cross sectional front view to show the nose assembly when the striking needle is not yet lowered.

Referring to FIGS. 2, 3 and 6, the nose assembly 2 for a nail ejection gun in accordance with the present invention comprises a nose piece 20 which has a guide channel 202 defined in a surface thereof and two holes 200 are defined in a first end of the nose piece 20. A resilient strip 3 has two holes 30 defined in a first end thereof so that the first end of the resilient strip 3 and the first end of the nose piece 20 are connected to a gun body I by bolts 40.

A guide base 25 is located below the nose piece 20 and has an extension channel 252 which is in alignment with the guide channel 202. A second end of the resilient strip 3 is connected to the guide base 25 by extending a rivet 41 through A first hole 31 in the second end of the resilient strip 3 and is securely engaged with a second hole 250 defined through the surface defining the extension channel 252 of the guide base 25. Two oblique surfaces 253 are respectively defined in two inside surfaces defining the extension channel 252 and a block 254 extends from a surface defining the extension channel 252. The block 254 has a tapered surface which communicates with the extension channel 252. Two grooves 255 are defined between the block 254 and the two oblique surfaces 253.

Figure 5:
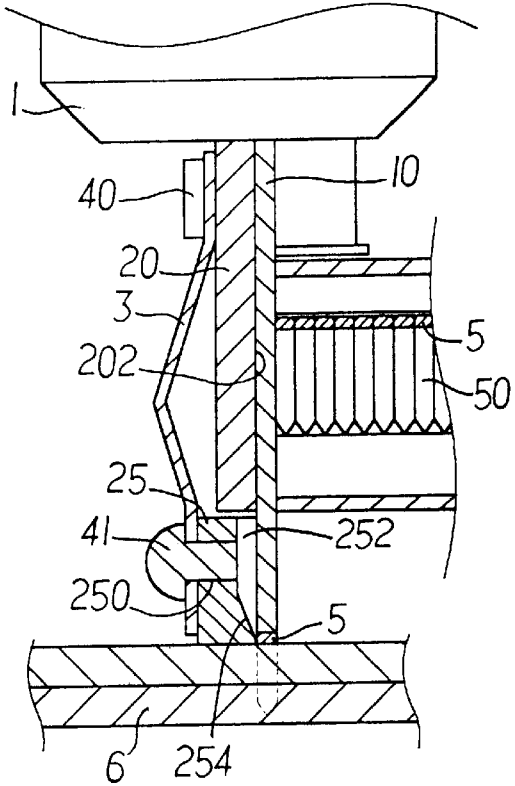
FIG. 5 is a cross sectional side view to show the nose assembly when the striking needle is lowered to push the guide base and the nail is inserted into an object.
Figure 4:
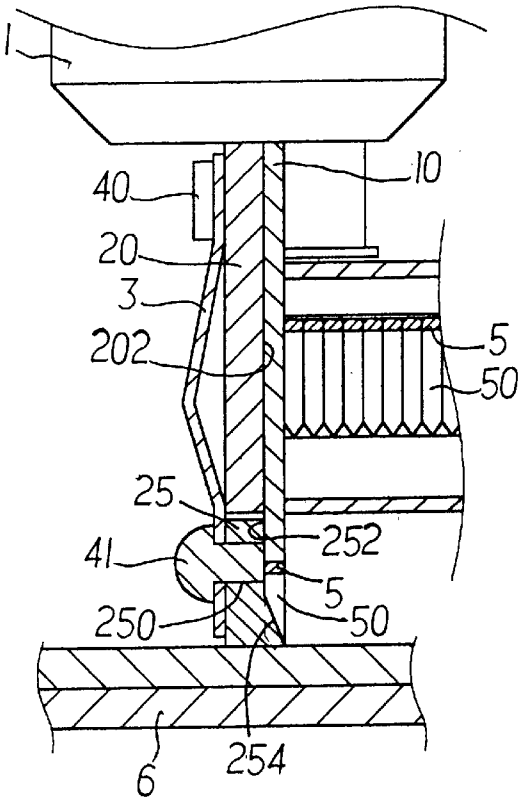
FIG. 4 is a cross sectional side view to show the nose assembly when the striking needle is lowered and ejects a nail which contacts the block.
Figure 8:
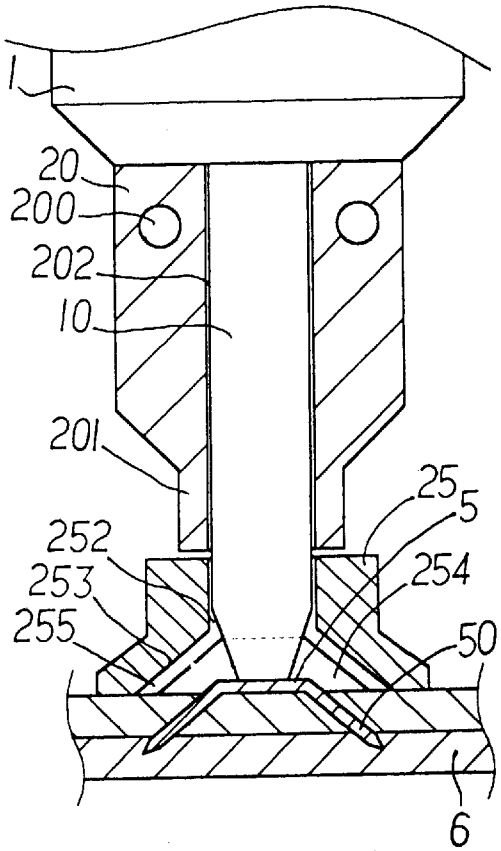
FIG. 8 is a cross sectional front view to show the nose assembly when the striking needle is lowered to push the guide base and the nail is inserted into an object.
Figure 7:
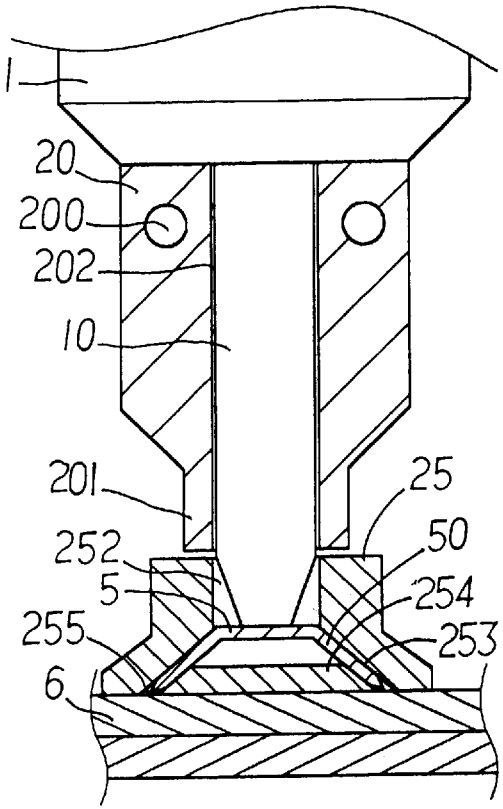
FIG. 7 is a cross sectional front view to show the nose assembly when the striking needle is lowered and ejects a nail which contacts the block.

Referring to FIGS. 4 and 7, when ejecting a nail 5 by lowering a striking needle 10, the two legs of the nail 5 are pushed to be inserted in the grooves 255 so that the two legs are expanded as shown. As shown in FIGS. 5 and 8, when the striking needle 10 is completely lowered to let the two legs penetrate through an object 6 below the guide base 25, the striking needle 10 contacts the tapered surface of the block 254 and then pushes the guide base 25 toward the resilient strip 3. The guide block 25 can be easily manufactured by machines and the precision of the two grooves 255 can be maintained.

Figure 9:
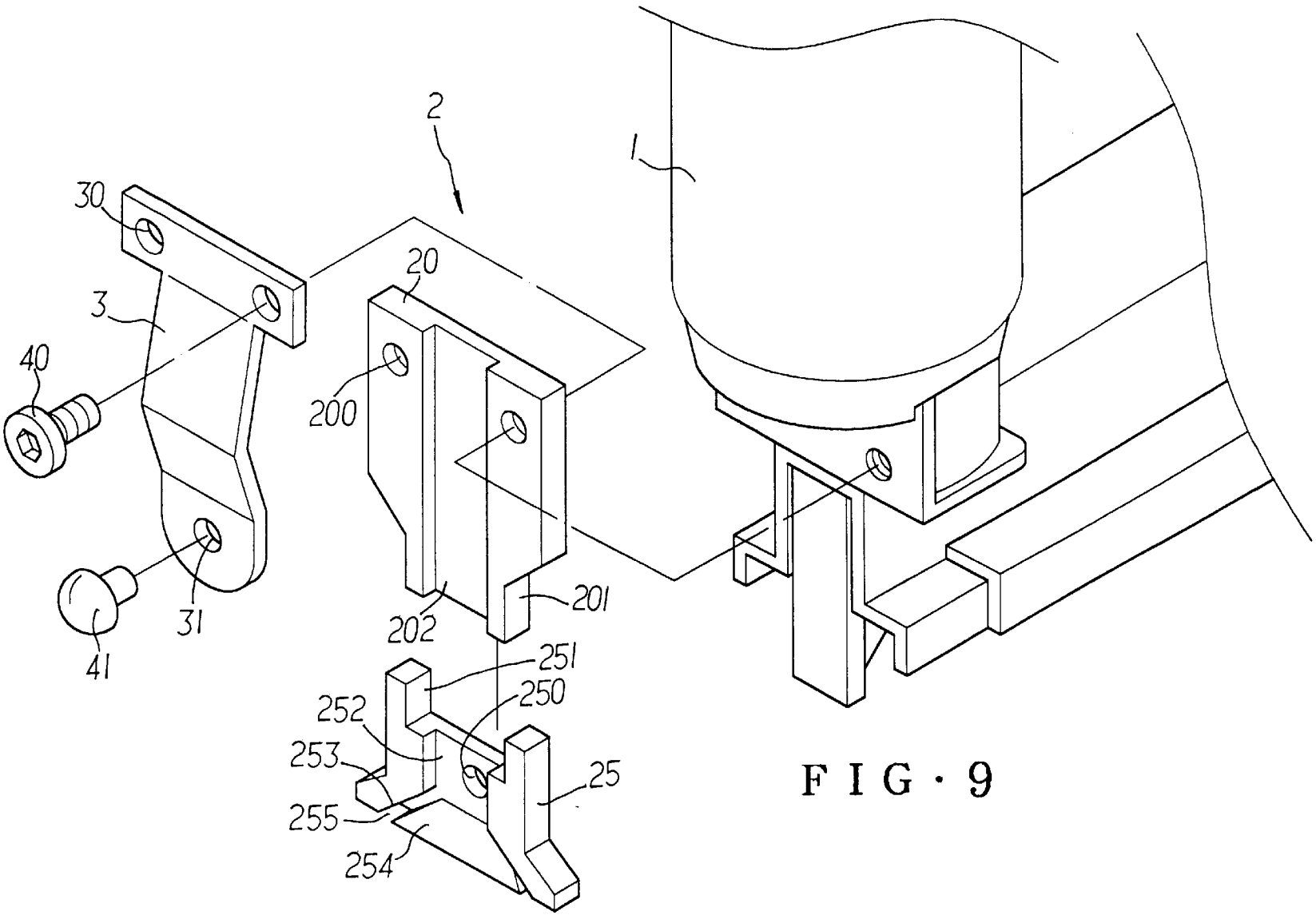
FIG. 9 is an exploded view to show another embodiment of the nose assembly for a nail ejection gun of the present invention.

FIG. 9 shows another embodiment of the nose assembly 2 for a nail ejection gun of the present invention wherein two retaining protrusions 251 respectively extend from a top of the guide base 25 and the second end of the nose piece 20 is movably located between the two retaining protrusions 251.

Figure 10:
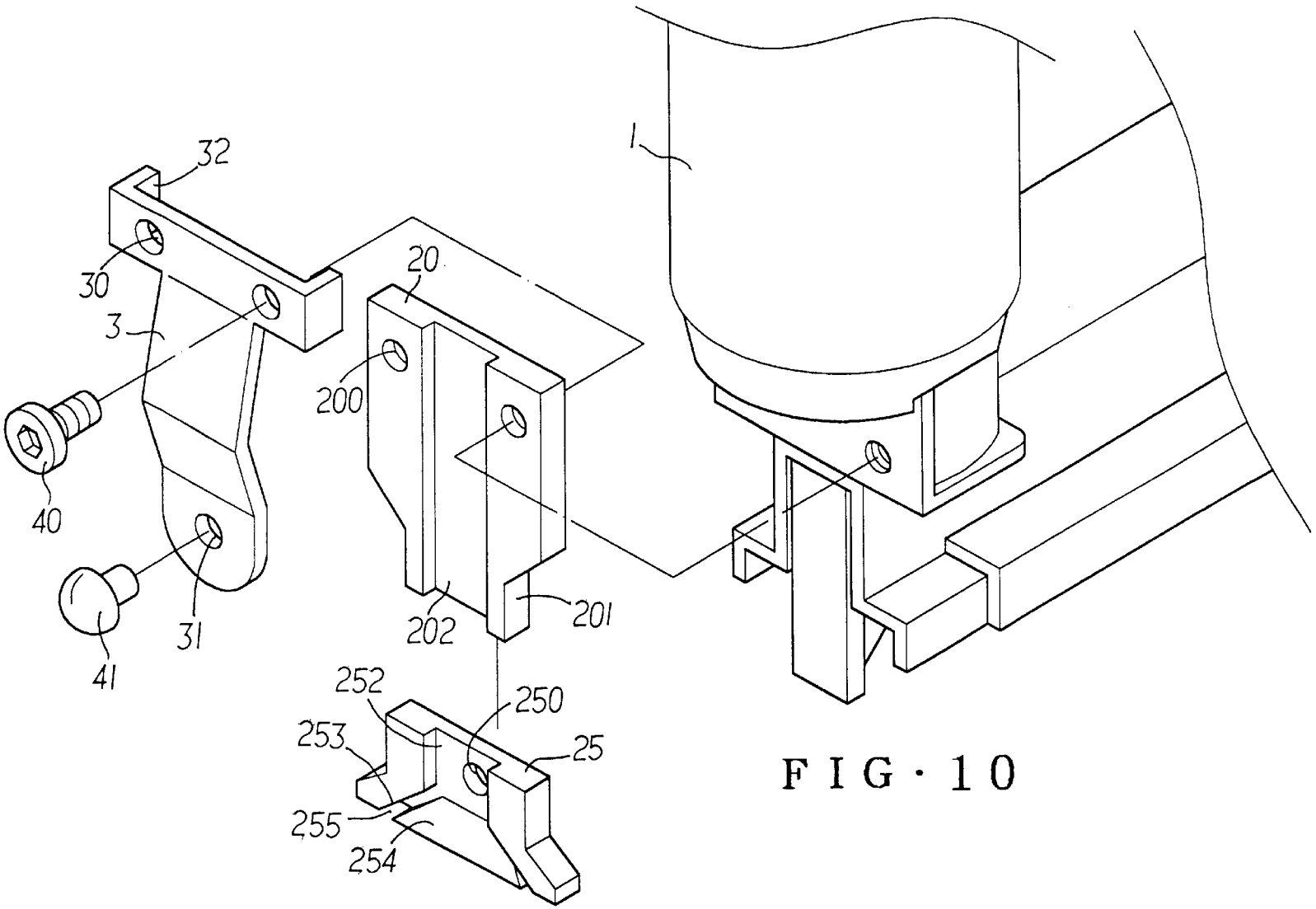
FIG. 10 is an exploded view to show yet another embodiment of the nose assembly for a nail section gun of the present invention.

FIG. 10 shows another embodiment of the nose assembly 2 for a nail ejection gun of the present invention wherein two sides 32 extend from edges at the first end of the resilient strip 3 so as to be securely connected to the gun body 1.

While we have shown and described various embodiments in accordance with the present invention, it should be clear to those skilled in the art that further embodiments may be made without departing from the scope and spirit of the present invention.

What is claimed is:

1. A nose assembly for a nail gun, comprising:

a nose piece having a guide channel defined in a surface thereof and said a first end of said nose piece adapted to be connected to a gun body;

a resilient strip having a first end thereof fixedly connected to said nose piece, and a guide base located below said nose piece and having an extension channel which is in alignment with said guide channel, a second end of said resilient strip connected to said guide base, two oblique surfaces respectively defined in two inside surfaces defining said extension channel, a block extending from a surface defining said extension channel and having a tapered surface which communicates with said extension channel, two grooves defined between said block and said two oblique surfaces.

2. The nose assembly as claimed in claim 1, wherein said second end of said resilient strip has a first hole defined therethrough and a second hole is defined through said surface defining said extension channel of said guide base, a rivet extending through said first hole and securely engaged with said second hole.

3. The nose assembly as claimed in claim 1 further comprising two retaining protrusions respectively extending from a top of said guide base and a second end of said nose piece located between said two retaining protrusions.

4. The nose assembly as claimed in claim 1 further comprising two sides extending from edges at said first end of said resilient strip.

* * * * *